US010001251B2

(12) United States Patent
Plott

(10) Patent No.: US 10,001,251 B2
(45) Date of Patent: Jun. 19, 2018

(54) LANTERN

(71) Applicant: Matthew R. Plott, Nibley, UT (US)

(72) Inventor: Matthew R. Plott, Nibley, UT (US)

(73) Assignee: MRP DESIGN ENGINEERING, LLC, Nibley, UT (US)

( * ) Notice: Subject to any disclaimer, the term of this patent is extended or adjusted under 35 U.S.C. 154(b) by 0 days. days.

(21) Appl. No.: 14/977,131

(22) Filed: Dec. 21, 2015

(65) Prior Publication Data

US 2017/0152997 A1 Jun. 1, 2017

Related U.S. Application Data

(63) Continuation-in-part of application No. 29/547,156, filed on Dec. 1, 2015.

(51) Int. Cl.

| | |
|---|---|
| ***G08B 13/00*** | (2006.01) |
| ***F21L 4/00*** | (2006.01) |
| ***F21V 23/04*** | (2006.01) |
| ***F21V 21/40*** | (2006.01) |
| ***G08B 13/189*** | (2006.01) |
| *F21Y 115/10* | (2016.01) |
| *G08B 7/06* | (2006.01) |

(52) U.S. Cl.

CPC ..... *F21L 4/00* (2013.01); *F21V 21/406* (2013.01); *F21V 23/0471* (2013.01); *G08B 13/189* (2013.01); *F21Y 2115/10* (2016.08); *G08B 7/06* (2013.01)

(58) Field of Classification Search

CPC combination set(s) only.

See application file for complete search history.

(56) References Cited

U.S. PATENT DOCUMENTS 5,588,738 A * 12/1996 Meoli ..... F21L 4/02 362/184

D541,961 S 5/2007 Tarter et al.
D610,283 S 2/2010 Loibl
D611,630 S 3/2010 Chan (Continued)

OTHER PUBLICATIONS

Coleman Mini Lanterns, http://www.coleman.com, retrieved Oct. 5, 2015. (2 pages).

(Continued)

*Primary Examiner* — Travis Hunnings
(74) *Attorney, Agent, or Firm* — Workman Nydegger

(57) ABSTRACT

A portable lantern may include a body that extends from a bottom portion to a top portion, and a light source disposed on or within the body (e.g., within the bottom portion or top portion). The lantern may advantageously include motion detection capabilities included therein. As such, the lantern may further include one or more motion detectors disposed on or within the body. In an embodiment, 3 motion detectors are provided, and the body is generally triangular, with a motion detector positioned at each apex of the generally triangular body. The motion detectors may be operatively coupled to the light source and/or an alarm so that upon detection of motion within the vicinity of the lantern, either the light source illuminates (from an initially dark configuration), the alarm sounds, or both. A plurality of modes of operation may be provided, allowing the user to select a desired mode.

20 Claims, 5 Drawing Sheets

(56) References Cited

U.S. PATENT DOCUMENTS

| | | | | |
|---|---|---|---|---|
| 8,232,909 | B2 * | 7/2012 | Kroeger | F21V 23/0442 340/500 |
| 8,432,281 | B2 * | 4/2013 | Reese | G08B 13/19 340/540 |
| 8,519,883 | B2 * | 8/2013 | Drake | F21V 23/0442 340/500 |
| D694,445 | S | 11/2013 | Shiu | |
| 8,662,699 | B2 | 3/2014 | Tarter | |
| D742,052 | S | 10/2015 | Dorman | |
| D759,869 | S | 6/2016 | Huang | |
| 2007/0201220 | A1 * | 8/2007 | Ulicny | B65D 23/00 362/101 |
| 2011/0012734 | A1 * | 1/2011 | Reese | G08B 13/19 340/541 |
| 2012/0293076 | A1 * | 11/2012 | Drake | F21V 23/0442 315/152 |
| 2014/0321106 | A1 * | 10/2014 | Workman | F21L 4/02 362/183 |

OTHER PUBLICATIONS

Coleman 4AA Packaway Mini LED Lantern, http://www.amazon.com, retrieved Oct. 5, 2015. (5 pages).
Coleman Full Size Lanterns, http://www.coleman.com, retrieved Oct. 5, 2015 (2 pages).
U.S. Appl. No. 29/547,156, filed Dec. 1, 2015, Plott.
Restriction Requirement for U.S. Appl. No. 29/547,156 dated Oct. 6, 2017, 5 pages.

* cited by examiner

LANTERN

BACKGROUND OF THE INVENTION

1. The Field of the Invention

The invention relates to lanterns such as used in camping, or other nighttime or dark environment activities where portable lantern lighting (e.g., in an environment where grid power is not available) would be desired.

2. The Relevant Technology

Various lanterns are commercially available from many manufacturers. For example, COLEMAN, as well as other manufacturers, sell various models of lanterns. While various models of lanterns are available, there is a continuing need for improved lanterns with added functionality, better reliability, long product life, and the like.

BRIEF SUMMARY

The disclosure relates to portable lanterns such as may be used while camping, or other activities where a portable light source would be desirable. In an embodiment, the lantern may include a body including a top portion and a bottom portion, and a light source (e.g., one or more LEDs) disposed on or within the body. One or more motion detectors may be provided on or within the body. The motion detectors may be selectively operably coupled to the light source, and/or to an alarm so that when the one or more motion detectors detects movement, the light source may illuminate (from an initially dark configuration), an alarm may sound, or both.

In an embodiment, the motion detectors may be disposed and oriented, spaced apart from one another, so as to provide motion detection across a full 360° perimeter around the lantern. For example, 3 motion detectors may be provided, each arranged 120° apart from one another. In an embodiment, the body of the lantern may be generally triangular, with a motion detector positioned at each apex of the generally triangular lantern body.

These and other advantages and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF DISCLOSED EMBODIMENTS

I. Introduction

Embodiments of the disclosure relate to lanterns such as used while camping, or for other activities where a portable lantern light source is desired. In an embodiment, the portable lantern includes a body that extends from a bottom portion to a top portion, and a light source disposed on or within the body (e.g., within the bottom portion or top portion). The lantern may advantageously include motion detection capabilities included therein. As such, the lantern may further include one or more motion detectors disposed on or within the body. The motion detectors may be operatively coupled to the light source and/or an alarm so that upon detection of motion within the vicinity of the lantern, either the light source illuminates (from an initially dark configuration), the alarm sounds, or both. In an embodiment, the lantern includes an alarm, and both the alarm sounds and the light source is illuminated when motion is detected, if that is the setting selected by the user.

For example, the lantern may include controls disposed thereon that allow the user to select what the result is when motion is detected. For example, the controls may allow the user to select an outcome (e.g., a first outcome) that illuminates the light source when motion is detected (but does not cause the alarm to sound). The controls may allow the user to select another outcome (e.g., a second outcome) that illuminates the light source and sounds the alarm when motion is detected. Another possible configuration might allow the user to select an outcome (a third outcome) where the light source is not illuminated, but the alarm sounds when motion is detected.

II. Exemplary Lanterns

Figure 1:
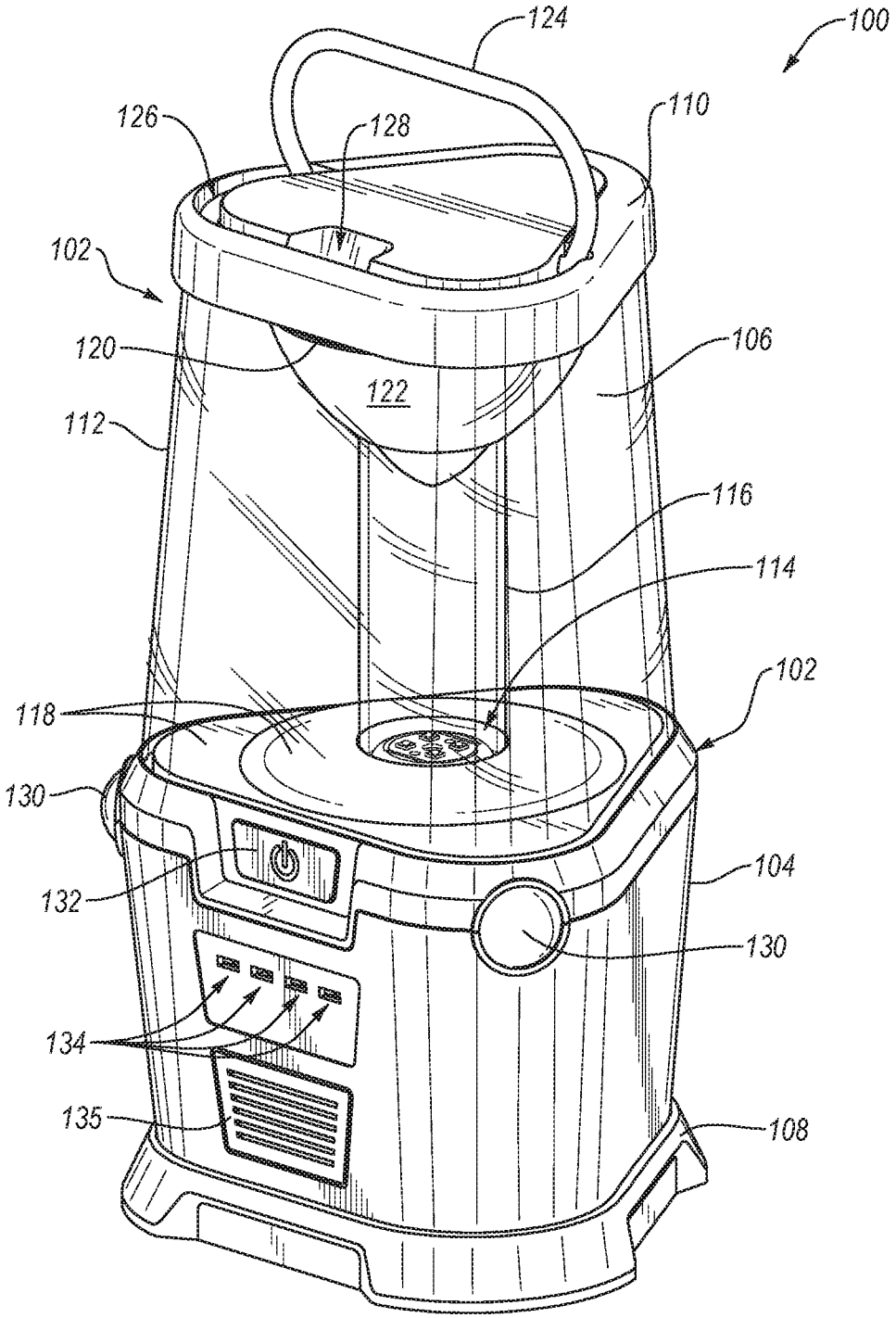
FIG. 1 is a front perspective view of an exemplary lantern.

FIG. 1 illustrates an exemplary lantern 100. Lantern 100 is shown as including a generally triangular body 102, where the lantern body extends from a bottom portion 104 to a top portion 106. A support base 108 may be provided about bottom portion 104. Such support base may have the same general shape as the body (e.g., generally triangular), and may be wider than the bottom portion 104 as shown, to provide improved stability. The top portion 106 may include a cap 110 that covers (e.g., provides a protective covering) for top portion 106. The cap 110 may similarly be generally triangular, and wider than the top portion 106 to which it is adjacent, to better protect the top portion 106, e.g., transparent cover 112.

As seen, the top portion 106 to which cap 110 may be attached may be or include a transparent cover 112 that extends around the region where the light from the light source 114 is emitted. Transparent cover 112 may also be generally triangular (matching the general shape of the top and bottom portions of lantern 100. The light source 114 is shown as being disposed within an interior light diffusing cylinder 116, e.g., at the longitudinal center of the triangular body 102. Light diffusing cylinder 116 may not be transparent, which does not permit the user to directly see the LEDs or other light source disposed therein (as are seen in FIG. 1 for purposes of illustrating the components), but this cylinder may be translucent, e.g., white, allowing light generated from the LEDs or other light source disposed therein to be seen as a relatively diffuse light, that lights the length of cylinder 116. Although the brightness of the emitted light may appear relatively brighter adjacent the base of cylinder 116 when light source 114 is illuminated (where the LEDs are disposed there), the length of the cylinder 116 may be illuminated when the light source 114 is activated. Of course, it will be apparent that the light source 114 may be disposed elsewhere than as shown in FIG. 1 (e.g., at the top of cylinder 116, for example).

In addition to transparent cover 112, the top portion of lantern body 102 is also shown as including a reflective bottom surface 118 and an upper reflective surface 120. Reflective bottom surface 118 is shown as extending from cylinder 116 outwardly to transparent cover 112. Upper reflective surface 120 may include a curved (e.g., parabolic, convex) reflector portion 122 extending outwardly and upwardly from cylinder 116. Such a convexly curved surface 122 may aid in improving light output, redirecting light emitted from cylinder 116 to be transmitted through transparent cover 112 in a trajectory that is more normal to the cover 112 than would occur without curved reflective surface 122. As shown, transparent cover 112 may taper inwardly, so that at its top (adjacent cap 110), the cover 112 may define a smaller cross-sectional triangle than defined at the bottom of cover 112 (adjacent the motion detectors 130, also referred to herein as sensors 130).

Figure 2:
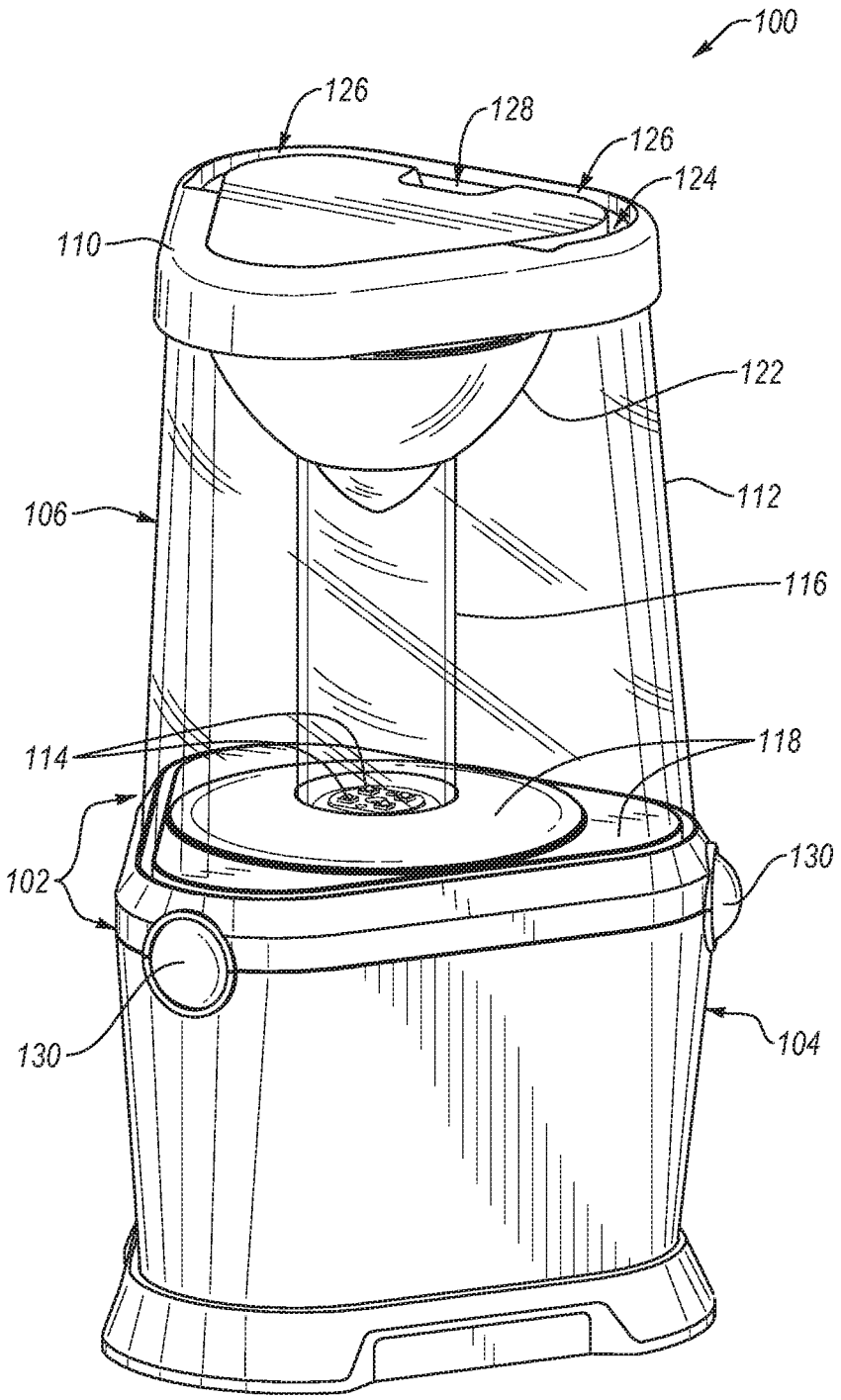
FIG. 2 is a rear perspective view of the lantern of FIG. 1.
Figure 3:
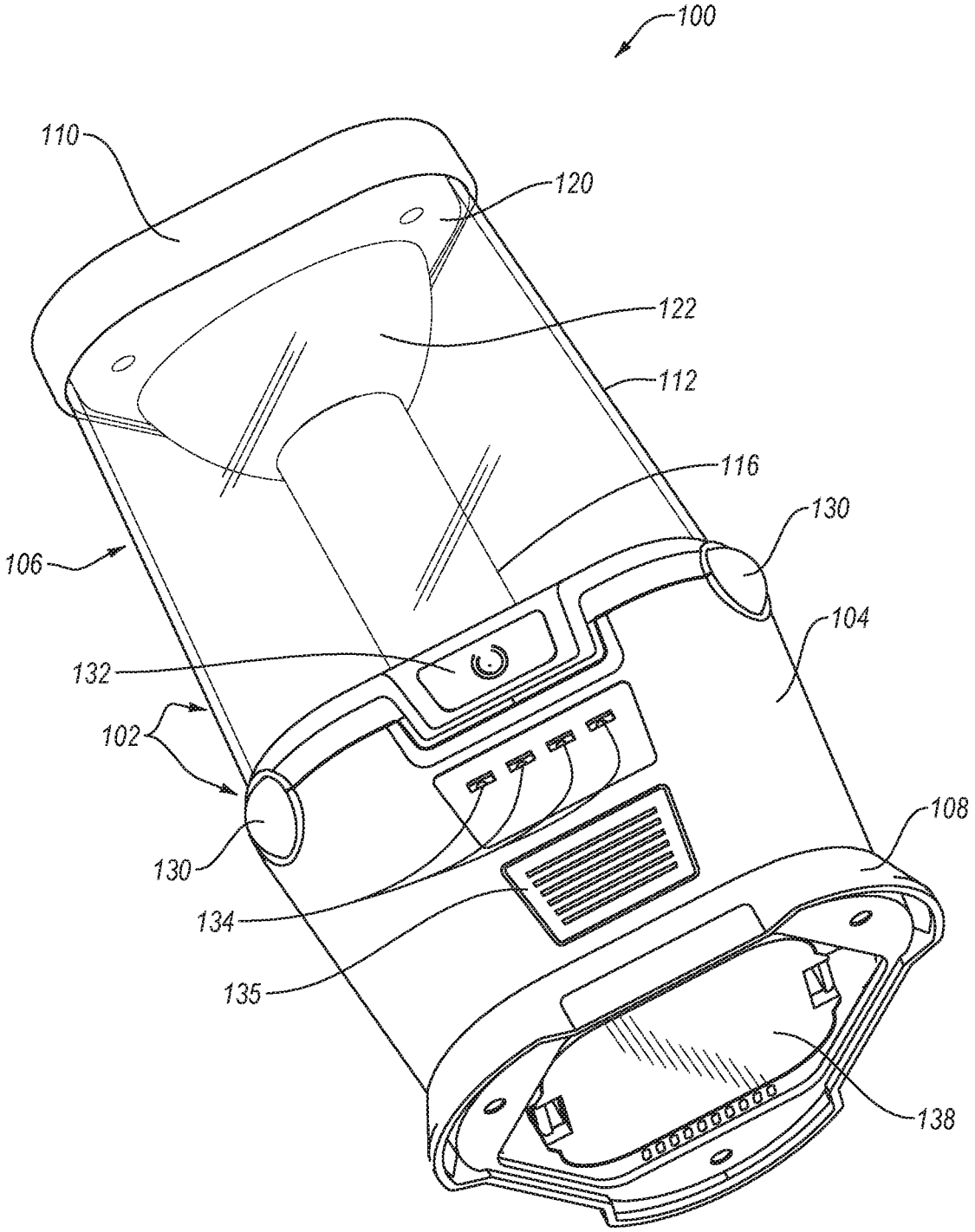
FIG. 3 is a bottom perspective view of the lantern of FIG. 1.

FIG. 1 further shows a swiveling handle 124 attached to cap 110, and which handle 124 can swivel from the extended position seen in FIG. 1, to a stowed position seen in FIG. 2. As seen, the cap 110 may include a recess 126 formed in the top surface of the cap 110, for receipt of swivel handle 124 when the handle 124 is stowed. This allows handle 124 to not protrude above the surface (e.g., flat) of cap 110 when stowed. Recess 126 is shown as further including a widened finger access location 128 at the center along the length of recess 126, allowing a user to easily engage the handle 124 with a finger and swivel the handle 124 up from the stowed position, when it is desired to carry the lantern 100 by the handle 124. As shown, the handle 124 may be generally oval shaped, and be configured so as to be stowed so that it wraps around a portion of the generally triangular perimeter defined by cap 110. For example, it may extend generally from at or near one apex of the triangular perimeter to at or near an adjacent apex of the triangular perimeter, as shown, when stowed in recess 126.

Lantern 100 may further include one or more motion detectors 130. In the illustrated configuration, a motion detector 130 is disposed at each apex (or corner) of the generally triangular body 102. For example, the motion detectors 130 may be positioned at a location that is at or near a top of the bottom portion 104 of lantern body 102 e.g., just below transparent cover 112. The illustrated configuration in which the motion detectors 130 are positioned at the outer perimeter, at the apexes of the generally triangularly shaped body 102 positions the motion detectors 130 so as to be 120° apart from one another, equally spaced about the perimeter of body 102. Such placement has been found to advantageously provide for full 360° motion detection around the lantern. While a configuration with more apexes and more motion detectors may be possible (e.g., a square or rectangular lantern body shape with placement at the corners, every 90°, or more sensors, even more closely spaced), such a configuration would require one or more additional motion detectors, increasing costs. The generally triangular body shape, paired with positioning of the motion detectors 120° apart from one another, has been found to be particularly cost effective, while providing the desired full 360° motion detection.

Advantageously, the motion detectors 130 are disposed on the lantern body itself, rather than being perhaps provided separate from the lantern, and requiring a user to place the motion detectors around some perimeter to be monitored. Such set up is cumbersome, requiring the user to actually set up the perimeter to be monitored for movement. The configuration embodied in the lantern as described herein advantageously includes the motion detectors 130 disposed on or within the lantern 100, oriented outwardly (rather than positioned out on a perimeter and oriented inwardly), so that set up is as simple as merely placing the lantern in a desired location, at which point the motion detectors automatically are already positioned to monitor a perimeter around the lantern for movement.

By way of example, in an embodiment, the motion detectors 130 may provide lantern 100 with a detection perimeter that detects motion within a perimeter of about 20 feet, about 30 feet, or up to about 40 feet radius from lantern 100. Of course, depending on the sensitivity of the selected sensors 130, a larger or smaller detection perimeter may be provided.

The lantern is further shown as including controls on the body of the lantern, which allow the user to select how the lantern is to function. For example, as shown, the controls may be relatively simple, including a single button 132 which can be pressed to select one of various modes of operation available. As shown, a plurality of light-up or other indicators 134 may be provided near (e.g., immediately below) the control button 132. Pressing button 132 may cause the first indicator 134 to be illuminated or otherwise indicated as selected. For example, the indicators 134 may be labeled "low", "high", "motion", and "alarm". Of course, other modes of operation could alternatively or additionally be provided. An electronics assembly may be provided within the lantern 100, operatively connecting button 132 with indicators 134, and with light source 114 and the alarm.

By way of example, upon pressing button 132, the first indicator 134 (e.g., "low") may illuminate, indicating the controls have been manipulated to select that mode of operation. This may cause the light source to illuminate, at a given first level of light output. Upon pressing the button 132 a second time, the second indicator 134 ("high") may illuminate, indicating the controls have been manipulated to select that mode of operation. This may cause the light source to illuminate at a given, second, higher, level of light output.

Upon pressing the button 132 a third time, the third indicator 134 ("motion") may illuminate, indicating the controls have been manipulated to select that mode of operation. In this mode, the light source may go off (e.g., after a given period of no motion being detected by sensors 130). While in this mode, as soon as motion is detected, the light source may be automatically illuminated. It may again go off if no motion is detected for a given period of time. By way of example, where no motion is detected for a period of several seconds, the light source may be turned off. For example, this time frame may be about 5 seconds, about 10 seconds, about 15 seconds, about 20 seconds, about 30 seconds, about 1 minute, or the like. The time frame may be within a range defined between any such time periods (e.g., 5 seconds to 1 minute). When in this mode, when the light is illuminated, the level of brightness may be equal to the level provided when "low" is selected, or alternatively, it may be equal to the level provided when "high" is selected. Of course, another level of brightness could be provided.

Upon pressing the button 132 a fourth time, the fourth indicator 134 ("alarm") may illuminate, indicating the controls have been manipulated to select that mode of operation.

In this mode, the light source may go off, and as soon as motion is detected, the light source may automatically be illuminated, and an audible alarm may sound. In a preferred embodiment, when motion is detected in this mode, both the light source is illuminated and the alarm sounds. The alarm may sound for a given period of time, after which it may turn off (and the light source may similar turn off within this same time frame). For example, this time frame may be about 5 seconds, about 10 seconds, about 15 seconds, about 20 seconds, about 30 seconds, about 1 minute, or the like. This time frame may be within a range defined between such time periods as described above. In another embodiment, the alarm and or the light source may remain on until the user again presses the control button 132. Sound from the alarm may exit through vents 135 (e.g., and a speaker therebehind).

When in the fourth mode (or whatever the last selectable operating mode is), and the control button 132 is pressed again, the lantern may again revert to a full "off" mode, where none of indicators 134 are illuminated, no motion detection is provided, etc. By pressing the control button again, the first mode (e.g., "low") may again be selected. This configuration allows the user to progressively track through the various offered modes of operation, selecting the one they wish to be active.

While any light source may be employed, it is particularly preferable that the light source be one that does not need replacement over the life of the lantern. As such, LEDs are a particularly preferred light source, as they may have a life of 50,000 hours, 75,000 hours, or even 100,000 hours.

While the generally triangular body shape shown in the Figures may be particularly preferred, it will be appreciated that other shaped body configurations may be possible for the cross-section of the body (e.g., other polygon shape, circular shape, shape including straight edges and curved edges, etc.). The generally triangular shape shown includes a triangular shape with rounded apexes or corners of the triangular, where the motion detectors are positions on the body at these rounded apexes. Furthermore, as shown, the generally triangular cross-section may be tapered in the longitudinal direction. For example, as shown, the widest (largest triangle) portion of generally triangular body 102 may be at the top of bottom portion 104, where the transition from bottom portion 104 to top portion 106 occurs. From this widest location, the bottom portion 104, the top portion 106, or both may taper so as to be narrower adjacent cap 110 and support base 108. As described above, the generally triangular shape advantageously positions the motion detectors 130 120° apart, which is close enough to provide for full 360° motion detection. For example, the motion detectors may have a field of sensitivity or motion detection that is somewhat greater than 120°, so that there is some overlap from one sensor 130 to the next. If only 2 motion detectors positioned 180° apart were used, it may be difficult if not impossible to achieve full 360° motion detection, particularly where the field of sensitivity of the sensors is less than 180°. For this reason, the triangular shape and 120° spacing is preferred, as it is very effective, while also minimizing the number of motion detectors needed. As used herein, "generally triangular" includes such shapes as shown, e.g., a triangle with rounded apexes, and the like.

Figure 4A:
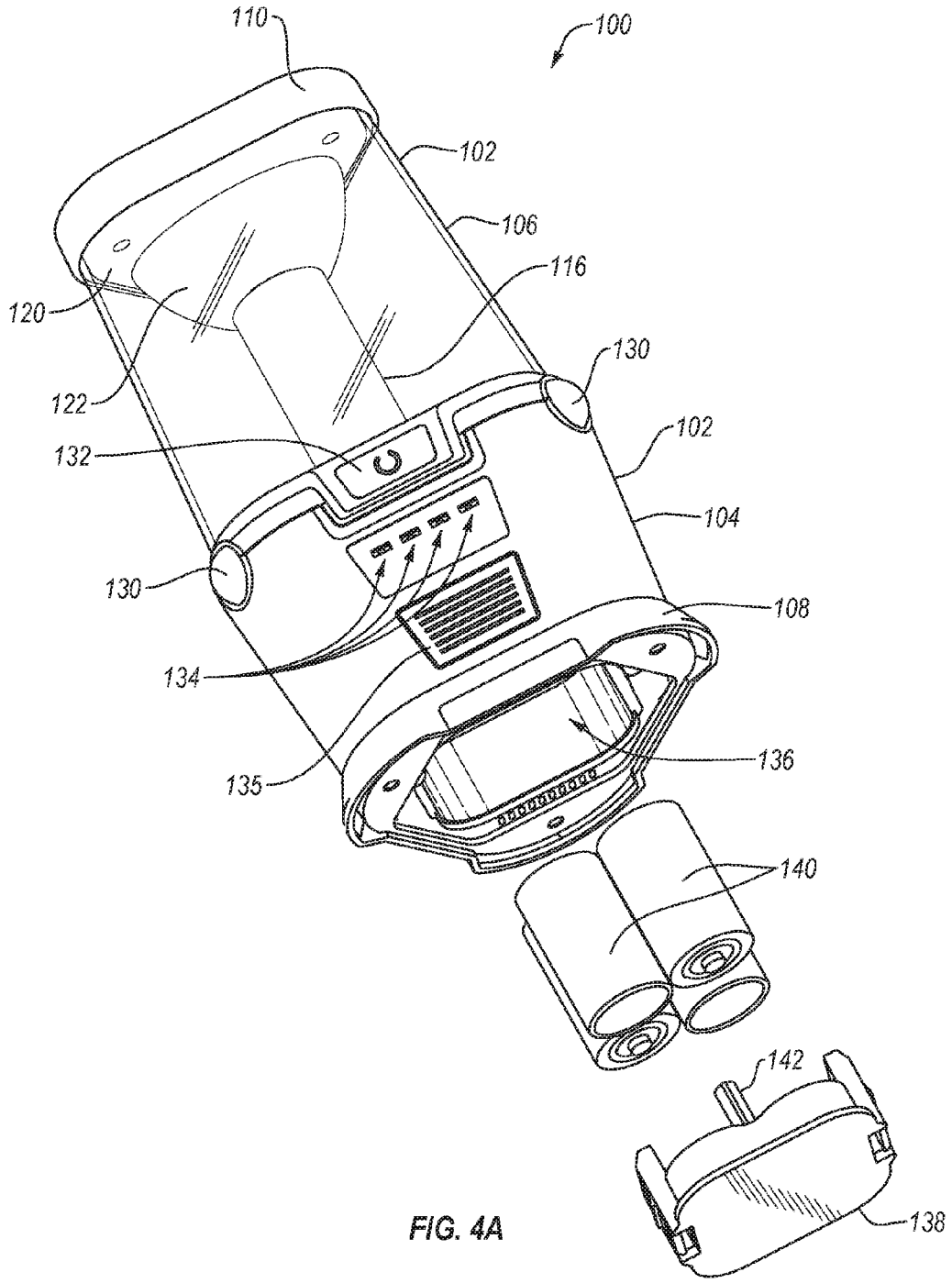
FIG. 4A is a bottom perspective view similar to that of FIG. 3, showing an opened battery compartment within the bottom portion of the lantern body.
Figure 4B:
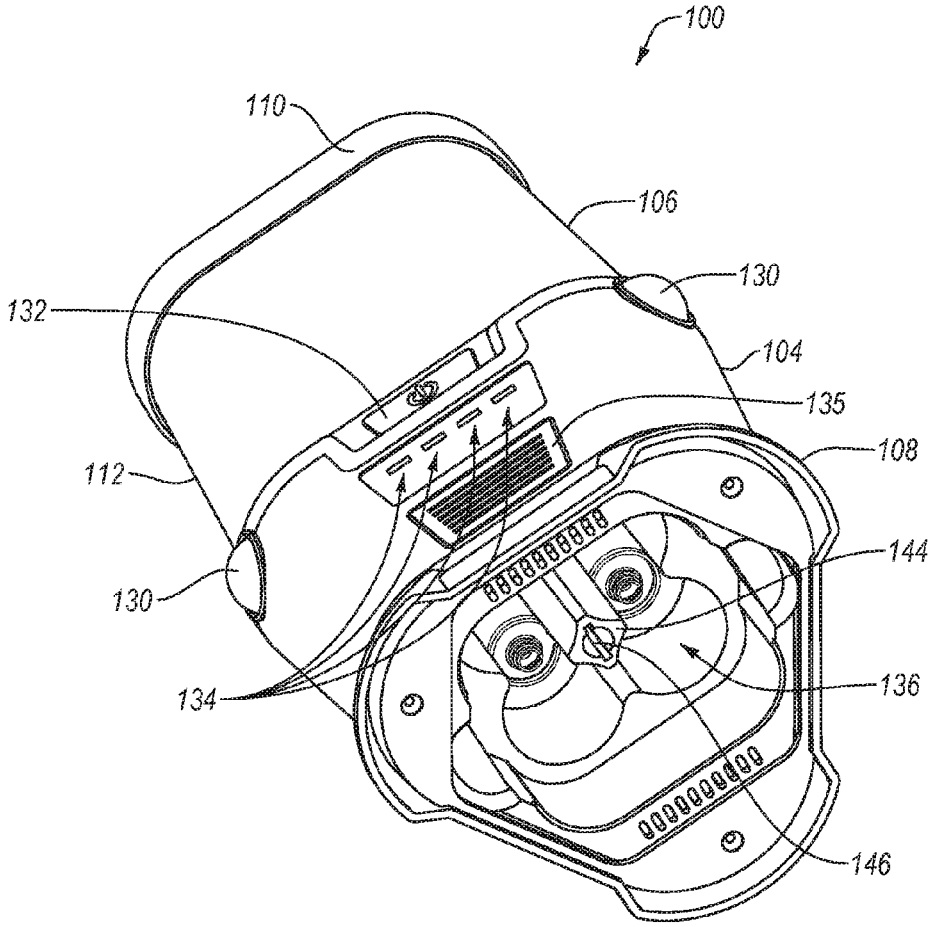
FIG. 4B is a bottom perspective view similar to that of FIG. 4A, but better showing down into the battery compartment of the lantern body.

The controls, light source, and alarm may be powered by any suitable power source. In an embodiment, as seen in FIGS. 4A-4B, a battery compartment 136 may be provided within body 102, e.g., within bottom portion 104. Any suitable type of battery or batteries may be used. Other power sources (e.g., a capacitor) are also possible. In some embodiments, a rechargeable power source may be used. In the illustrated configuration, 4 "D" cell batteries are provided. Various other possibilities will be apparent to those of skill in the art in light of the present disclosure. As shown, the battery compartment 136 may be selectively closed by a removable battery compartment door 138 that closes over the battery compartment, holding the batteries 140 within compartment 136. In an embodiment, as seen in FIGS. 4A-4B, the battery compartment door 138 may include a centrally disposed guide 142 that mates with a corresponding guide 144 within the battery compartment 136, to guide closure of the battery compartment door 138 over the battery compartment 136.

For example, as will be appreciated from FIGS. 4A and 4B, guide 142 may be sized and shaped for receipt into a recess 146 formed along the longitudinal center of guide 144. As shown, guide 142 and recess 146 may be keyed to one another, to ensure proper orientation of door 138 over compartment 136. Various alternative configurations for mating a guide in the door with a guide in the compartment will be apparent to those of skill in the art, in light of the present disclosure.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A portable lantern comprising:

a body extending from a bottom portion to a top portion;

a light source disposed on or within the body;

a plurality of motion detectors disposed at an outer perimeter of the body, the plurality of motion detectors being spaced apart from one another, positioned at different locations along the outer perimeter of the body, the plurality of motion detectors being selectively operably coupled to the light source and an alarm such that the light source of the lantern may illuminate and the alarm may sound upon one or more of the motion detectors detecting movement adjacent to the lantern;

wherein all motion detectors operably coupled to the portable lantern are disposed on the outer perimeter of the body of the lantern, rather than there being any motion detectors that are provided separate from the lantern;

wherein the spaced apart motion detectors are spaced apart and oriented in a particular arrangement relative to one another that provides for motion detection in a radial 360° perimeter defined around the lantern, the plurality of motion detectors being at a center of the radial 360° perimeter defined around the lantern.

2. The portable lantern as recited in claim 1, wherein the lantern includes controls which allow a user to select one of a plurality of modes of operation, wherein one of the operating modes illuminates the light source and sounds the alarm when the one or more motion detectors detect movement adjacent to the lantern.

3. The portable lantern as recited in claim 2, wherein another of the plurality of modes of operation illuminates the light source without sounding the alarm when the one or more motion detectors detect movement adjacent to the lantern.

4. The portable lantern as recited in claim 1, wherein the body is generally triangular in cross-section, with apexes of the triangle being rounded, and where the plurality of motion detectors include 3 motion detectors, with a motion detector positioned at each apex of the triangle, 120° apart from one another.

5. The portable lantern as recited in claim 4, wherein the 3 motion detectors provide detection of motion across a circular perimeter extending at least 20 feet out, radially, around the lantern.

6. The portable lantern as recited in claim 1, wherein the light source comprises LEDs.

7. The portable lantern as recited in claim 1, further comprising a swivel handle attached to the top portion of the body, wherein the top portion of the body further comprises a recess formed therein for receipt of the swivel handle when the handle is stowed.

8. A portable lantern comprising:

a generally triangular body having a generally triangular cross-section extending from a bottom portion to a top portion;

a light source disposed on or within the body;

three motion detectors disposed at an outer perimeter of the body, wherein a first motion detector is positioned at a first apex of the generally triangular cross-section of the body, a second motion detector is positioned at a second apex of the generally triangular cross-section of the body, and a third motion detector is positioned at a third apex of the generally triangular cross-section of the body, the three motion detectors being spaced apart from one another and being selectively operably coupled to the light source such that the light source of the lantern may illuminate upon one or more of the motion detectors detecting movement adjacent to the lantern, wherein the three motion detectors are each oriented 120° apart from one another, at apexes of the generally triangular body so as to provide detection of motion in a radial 360° perimeter around the lantern, the three motion detectors being located at a center of the radial 360° perimeter defined around the lantern.

9. The portable lantern as recited in claim 8, wherein the lantern further comprises an audible alarm that is selectively operably coupled to the one or more motion detectors and wherein the lantern includes a mode of operation that both illuminates the light source and sounds the alarm upon the one or more motion detectors detecting movement adjacent to the lantern.

10. The portable lantern as recited in claim 8, further comprising a transparent cover extending around the light source.

11. The portable lantern as recited in claim 8, wherein the light source comprises LEDs.

12. The portable lantern as recited in claim 8, further comprising controls on the body of the lantern for selecting one of a plurality of modes of operation associated with operation of the light source and one or more motion detectors.

13. The portable lantern as recited in claim 8, further comprising a swivel handle attached to the top portion of the body.

14. The portable lantern as recited in claim 13, wherein the top portion of the body further comprises a recess formed therein for receipt of the swivel handle when the handle is stowed.

15. The portable lantern as recited in claim 8, wherein the body further comprises a battery compartment.

16. The portable lantern as recited in claim 15, wherein the battery compartment is disposed in the bottom portion of the body.

17. The portable lantern as recited in claim 16, further comprising a removable battery compartment door for closing the battery compartment.

18. The portable lantern as recited in claim 17, wherein the battery compartment door includes a centrally disposed guide that mates with a corresponding guide within the battery compartment, to guide closure of the battery compartment door over the battery compartment.

19. The portable lantern as recited in claim 1, wherein the radial 360° perimeter within which motion is detected as defined around the lantern extends to 20 feet, radially around the lantern.

20. The portable lantern as recited in claim 1, wherein the radial 360° perimeter within which motion is detected as defined around the lantern extends to 30 feet, radially around the lantern.

* * * * *